United States Patent [19]

Nakano

[11] Patent Number: 4,973,182

[45] Date of Patent: Nov. 27, 1990

[54] WRITING NIB MADE OF SYNTHETIC RESIN

[75] Inventor: Ken Nakano, Tokyo, Japan

[73] Assignee: Tsukasa Felt Shoji Co., Ltd., Tokyo, Japan

[21] Appl. No.: 416,420

[22] Filed: Oct. 3, 1989

[30] Foreign Application Priority Data

Oct. 8, 1988 [JP] Japan ..... 63-254279

[51] Int. Cl.[5] ..... B43K 8/08; B43K 1/06

[52] U.S. Cl. ..... 401/199; 401/265

[58] Field of Search ..... 401/198, 199, 292, 261, 401/265

[56] References Cited

U.S. PATENT DOCUMENTS 3,614,247 10/1971 Otsuka ..... 401/199
3,830,576 8/1974 Kohno et al. ..... 401/199 X
3,843,270 10/1974 Kiriv et al. ..... 401/199 X
3,933,965 1/1976 Gallone et al. ..... 401/199 X
4,076,428 2/1978 Otaki et al. ..... 401/265
4,362,683 12/1982 Otsuka et al. ..... 401/265 X
4,468,147 8/1984 Manusch et al. ..... 401/199 X
4,721,404 1/1988 Ito et al. ..... 401/198

*Primary Examiner*—Danton D. DeMille
*Attorney, Agent, or Firm*—Oliff & Berridge

[57] ABSTRACT

A stick-like writing nib, made of a synthetic resin, has a plurality of narrow slit-like first ink passages extending radially from the axis in sectional profile and a plurality of narrow slit-like second ink passages provided in sector-like areas in sectional profile defined by walls the first ink passage, which are defined by a plurality of walls extending parallel to a line bisecting an angle subtended by the sector-like area into two angels, and inner end portions of the first ink passages being defined by thin walls extending along the nib axis.

5 Claims, 6 Drawing Sheets

WRITING NIB MADE OF SYNTHETIC RESIN

BACKGROUND OF THE INVENTION

The present invention relates to a stick-like writing nib and, more particularly, to a writing nib made of synthetic resin suitable for use with the writing end cut to a wedge-like or chisel-like form for writing ornamented capital letters or calligraphic letters.

There have conventionally been fountain pens and pens in which a pen is put into a penholder for calligraphic letters or the like. The tip of these pens is usually made wider than the tip of the oridinary writing pen point or is bent to provide an increased area of contact with paper so as to permit writing of calligraphic letters or the like.

A marking pen uses a core which consists of a bundle of slivers secured together with an adhesive. The end of this core is cut to a wedge-like or chisel-like form to provide a surface permitting the drawing of a bold line and a surface permitting the drawing of a thin line. With this pen end calligraphic letters or the like can be written.

With the fountain pen noted above, the penmanship width is limited in a narrow range of about 1 mm. Besides, the writing mechanism is such that a line can be drawn only in limited directions. With the marking pen, the penmanship of writing has an unclear contour. Besides, the marking pen has poor durability and therefore its tip is readily damaged. Therefore, it is difficult to maintain an intended penmanship for long periods of time.

It has been tried to use a stick-like nib 30 (see FIGS. 10 and 11), which is known as an ordinary nib for writing with a conical pen tip, and which is made of a thermoplastic resin and has ink passages 31 extending in the longitudinal direction, by cutting its end to a wedge-like form for writing calligraphic letters or the like. In either case, however, the capillary action is weak at the center of the nib's in the cross section. Therefore, it results in failure of coating of ink on paper 32 at a central portion of the penmanship with the pen (as shown in FIGS. 12 and 13). In addition, the penmanship quality fluctuates, and it is difficult to ensure a constant quality of product.

SUMMARY OF THE INVENTION

An object of the present invention is to provide a writing nib made of a synthetic resin, which can be used with the nib cut to provide a wedge-like or chisel-like writing end, ensures coating of ink on the entire width of penmanship and clear penmanship contour and has high durability.

Another object of the invention is to provide a stick-like writing nib made of a synthetic resin and having a plurality of ink passages extending in the longitudinal direction, said plurality of ink passages including a plurality of narrow slit-like first ink passages radially from the axis in sectional profile and a plurality of narrow slit-like second ink passages provided in sector-like spaces defined by said first ink passages in such a manner that a plurality of walls of the narrow slit-like second ink passages are parallel to lines of angles bisecting the center angles of the sector-like spaces, said nib having thin walls extending along the axis of and defining each inner end of said first ink passages.

A further object of the invention is to provide a stick-like writing nib made of a synthetic resin, in which spaces constituting the ink passages are distributed uniformly even when cutting its end to provide a straight writing end, and the walls of the ink passages at the center are united together along the axis to prevent a phenomenon of "draw-back" of ink at the center of the nib.

A still further object of the invention is to provide a writing nib made of a synthetic resin, in which the walls defining ink passages have a substantially uniform width so that ink passages defined by these walls have a substantially uniform width.

A yet further object of the invention is to provide a writing nib made of a synthetic resin, in which the inner ends of the first ink passages are connected to thin walls.

The above and other objects, features and advantages of the present invention will be apparent from the detailed description when the same is read with reference to the accompanying drawings.

BRIEF DESCRIPTION OF THE DRAWINGS

The present invention will be described in greater detail in the following description with reference to the drawings, in which.

DETAILED DESCRIPTION OF THE PREFERRED EMBODIMENTS

Figure 1:
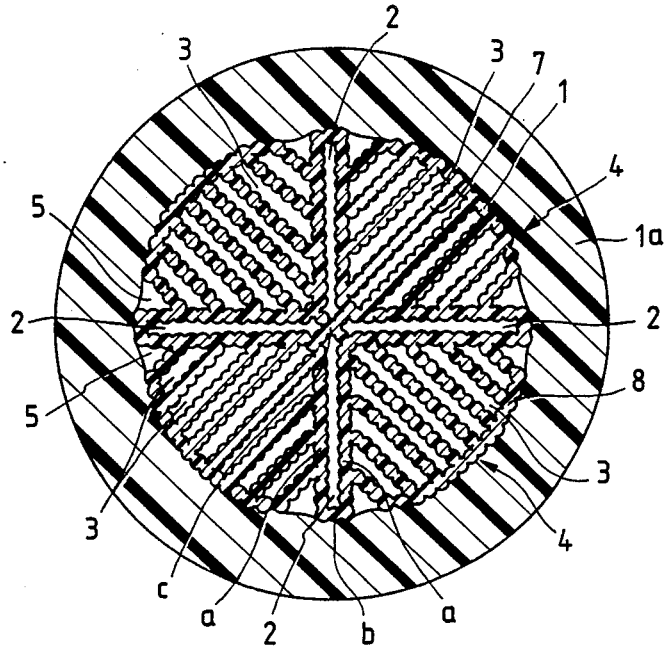
FIG. 1 is an enlarged-scale sectional view of a stick-like nib taken along I—I in FIG. 2.
Figure 2:
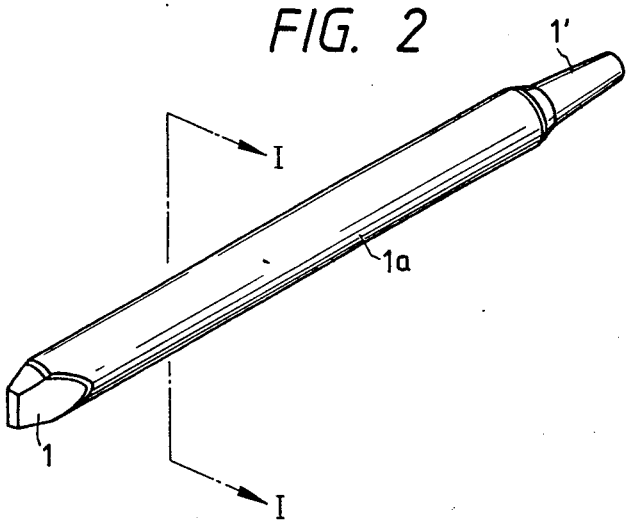
FIG. 2 is a perspective view showing the nib with an end cut to a wedge-like form.

FIGS. 1 and 2 show a first embodiment of the present invention.

Referring to the Figures, there is shown a stick-like nib comprising a nib body 1 and a cylindrical outer shell 1*a* covering the nib body 1. In this embodiment, the nib body 1 and outer shell 1*a* are moldings of polyvinylidene fluoride resin. The outer shell la may be molded integrally with the nib body 1, or it may be omitted.

The nib body is a molding of a thermoplastic synthetic resin having flexibility and strength, for instance polyoxymethylene resin, polyamide resin and polyvinylidene fluoride resin. In a process of its manufacture, a plurality of fused strings of resin are pulled out from a die, adjacent strings are caused to be self-bonded to one another, and the resultant system is elongated to a predetermined diameter and then cooled down.

The nib body 1 has four narrow slit-like first ink passages 2 radially extending from its axis and second narrow slit-like second ink passages 3 provided in spaces 4 having sector-like sectional profile defined between adjacent first ink passages 2.

In each of the sector-like spaces 4, a plurality of second ink passages 3 are defined by a plurality of (i.e., eight) walls 7 extending parallel to a line bisecting the angle (substantially 90°) subtended by the sector-like space 4 into two angles (each substantially of (45°).

The inner ends of the walls 7 terminate at the walls defining the first ink passages and the outer ends thereof terminate at an outer peripheral wall 8.

The four first ink passages 2 are each defined by two radially extending walls a, a circumferential wall b and a cross wall c partitioning each ink passage at the axis i.e., at each inner end of the first ink passages. The cross wall c consists of two perpendicular walls extending in lines bisecting the center angles of the sector-like spaces 4 and crossing each other. Depressions 5 are provided adjacent to the opposite sides of an outer portion of each of the first ink passages 2. These depressions 5 serve to absorb distortions of the nib body 1 when covering the nib body with the outer shell 1*a*.

The nib body 1 and outer shell 1*a*, as shown in FIG. 2, have a wedge-like or chisel-like cut front end and a tapered rear end 1'. The stick-like pen has its rear end disposed in an ink supply system and its front end projecting from a penholder.

Figure 3:
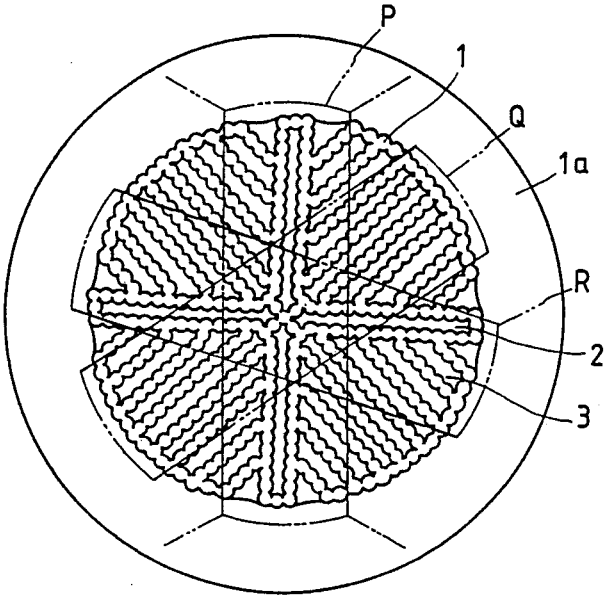
FIG. 3 is an enlarged-scale sectional view illustrating the direction of cutting of the tip of the nib to a wedge-like form.
Figure 9:
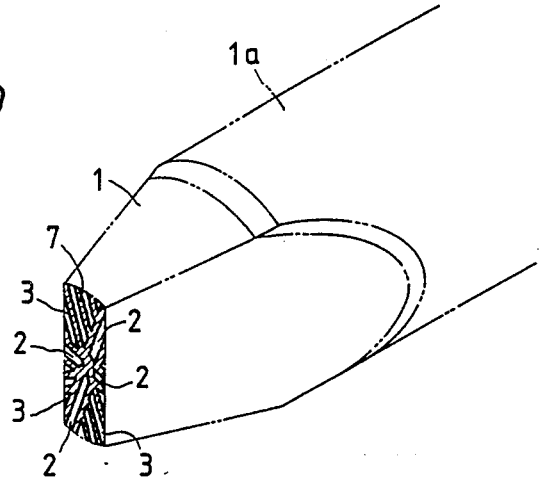
FIG. 9 is a view for explaining the state of cutting of the nib according to the present invention.
Figure 10:
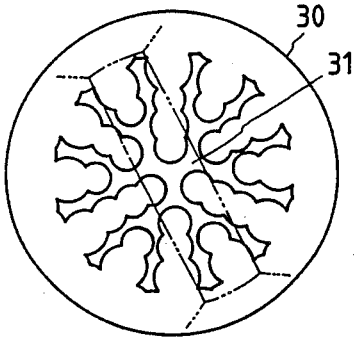
FIG. 10 PRIOR ART
FIGS. 10 and 11 are sectional views showing prior art nibs.
Figure 11:
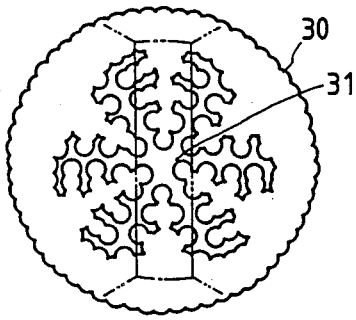
FIG. 11 PRIOR ART
Figure 12:
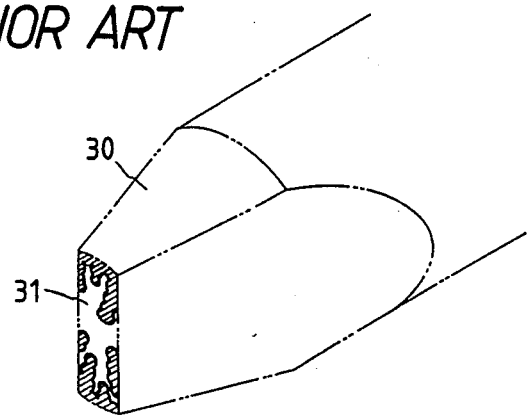
FIG. 12 PRIOR ART
FIG. 12 is a view for explaining the state of cutting of the end of prior art nib.
Figure 13:
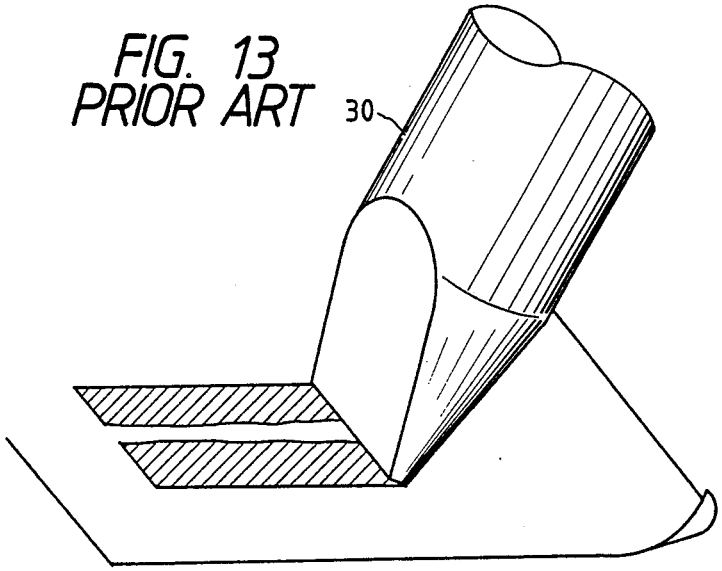
FIG. 13 PRIOR ART
FIG. 13 is a view for explaining the writing status of penmanship obtained with the prior art nib.

The front end of the nib body 1 may be cut to a wedge-like or chisel-like form in a manner as shown in P, Q or R in FIG. 3. In the case of R, a nib as shown in FIG. 9 is obtained. In either case of P to R, good performance of writing can be obtained.

Figure 4:
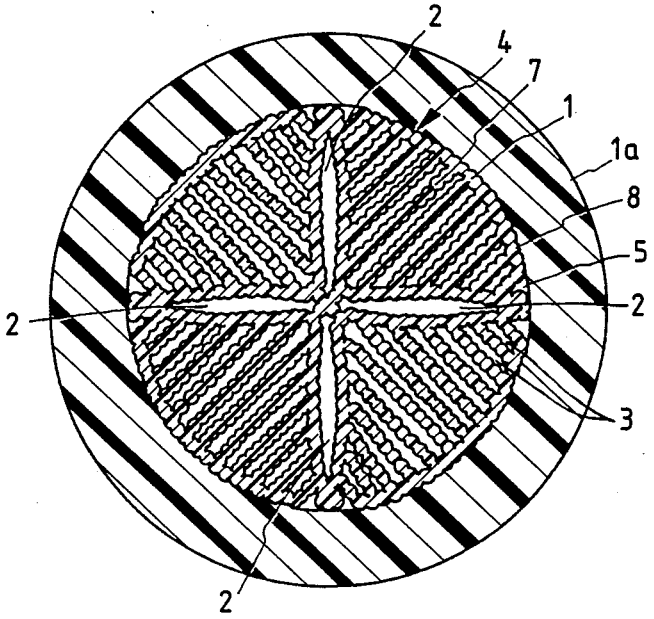
FIGS. 4 to 8 are views similar to FIG. 1 but showing respective second to sixth embodiments of the present invention.

FIG. 4 shows a second embodiment. In the FIG. 4 and other figures, the same parts are designated by the same numeral references or symbols, and are not described after they are once described.

In the embodiment of FIG. 4, the width of first ink passages 2 becomes smaller toward the outer periphery and also toward the axis of the nib body 1. For the rest, the structure is the same as that of the first embodiment.

Figure 5:
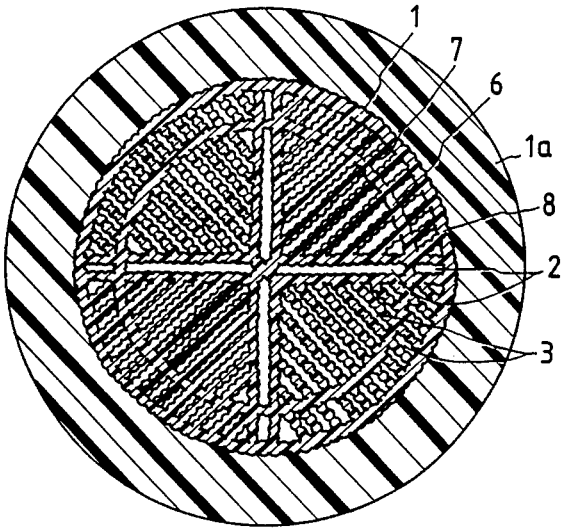

FIG. 5 shows a third embodiment. In this embodiment, an inner cylindrical wall 6 concentric with the outer peripheral wall 8 is provided to divide first and second ink passages 2 and 3. In this case, no depression is provided.

Figure 6:
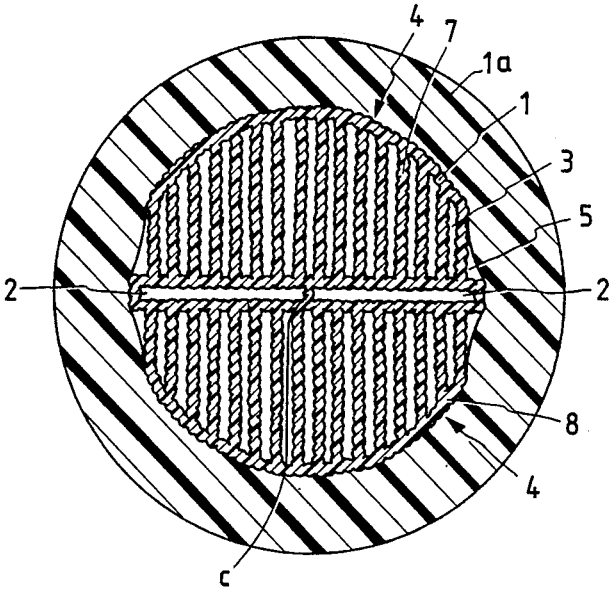

FIG. 6 shows a fourth embodiment, which has two first ink passages 2. In this case, the space defined by the two first ink passages should subtend an angle of 180°.

Figure 7:
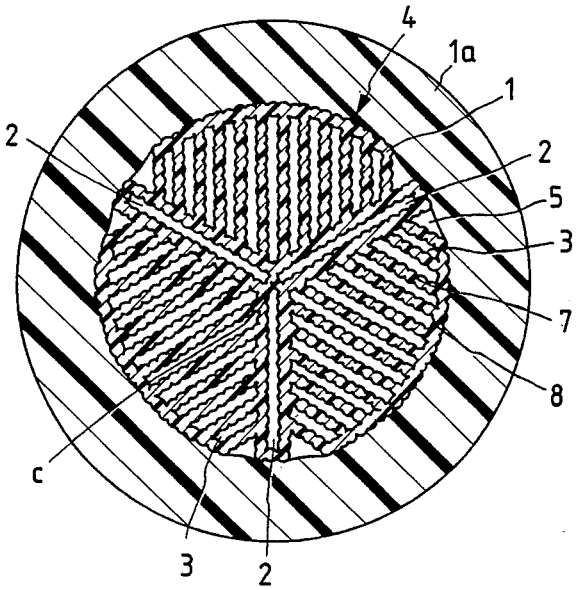

FIG. 7 shows a fifth embodiment, which has three first ink passages 2.

Figure 8:
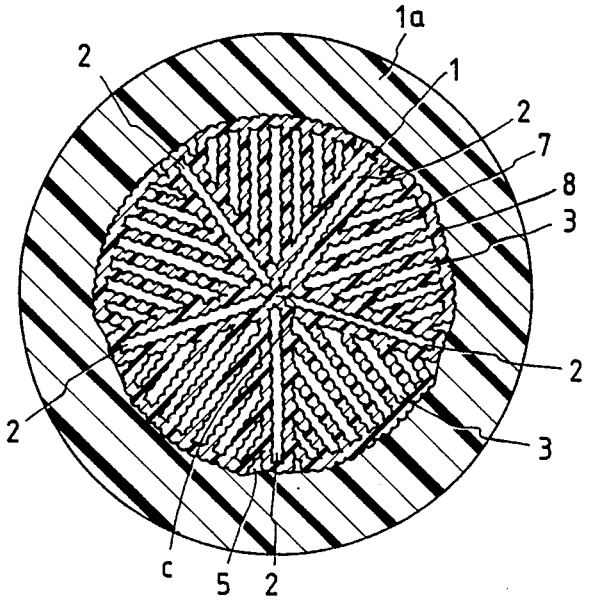

FIG. 8 shows a sixth embodiment, which has five first ink passages 2.

Examples of numerical values of a structure having four first ink passages are given below.

| I. A nib with 32 walls defining second ink passages | | |
|---|---|---|
| (1) Diameter of nib body: | ϕ1.0 mm | ϕ1.3 mm |
| (2) Diameter of nib inclusive of outer shell: | ϕ2.0 mm | ϕ2.0 mm |
| (3) Average thickness of walls: | 0.035 mm | 0.05 mm |
| (4) Average width of ink passages: | 0.02 mm | 0.025 mm |
| (5) Width of wide cut end: | 0.8 mm | 1.0 mm |
| (6) Width of narrow cut end: | 0.3 mm | 0.35 mm |

-continued

| | | |
|---|---|---|
| (7) Performance: | good | good |
| II. A nib with 48 walls defining second ink passages | | |
| (1) Diameter of nib body: | ϕ1.5 mm | ϕ1.8 mm |
| (2) Diameter of nib inclusive of outer shell: | ϕ2.0 mm | ϕ2.2 mm |
| (3) Average thickness of walls: | 0.05 mm | 0.05 mm |
| (4) Average width of ink passages: | 0.025 mm | 0.03 mm |
| (5) Width of wide cut end: | 1.2 mm | 1.5 mm |
| (6) Width of narrow cut end: | 0.35 mm | 0.4 mm |
| (7) Performance: | good | good |
| III. A nib with 64 walls defining second ink passages | | |
| (1) Diameter of nib body: | ϕ2.2 mm | |
| (2) Diameter of nib inclusive of outer shell: | ϕ3.0 mm | |
| (3) Average thickness of walls: | 0.05 mm | |
| (4) Average width of ink passages: | 0.025 mm | |
| (5) Width of wide cut end: | 2.0 mm | |
| (6) Width of narrow cut end: | 0.5 mm | |
| (7) Performance: | good | |

As has been shown in the above embodiments, the nib according to the present invention has the features that the walls defining the ink passages are united to one another and have no free end, that these walls extend substantially straight and that the ink passages defined by these walls also are substantially straight and have a uniform width.

What is claimed is:

1. A stick-like writing nib made of a synthetic resin and having a plurality of ink passages extending in a longitudinal axis, the plurality of ink passages formed in the writing nib comprising:

a plurality of narrow slit-like first ink passages extending radially from said axis in sectional profile and which are defined by walls, a plurality of narrow slit-like second ink passages, provided in sector-like areas in sectional profile defined by the walls of said first ink passages, said second ink passages defined by a plurality of walls extending parallel to a line bisecting an angle subtended by the sector-like area into two angles, each inner wall of the second ink passages connecting to the walls of the first ink passages, and a central wall along said longitudinal axis, defining inner ends of the first ink passages, and connected to inner ends of walls of the first ink passages.

2. A stick-like writing nib as claimed in claim 1, which comprises a nib body and an outer shell covering said nib body.

3. A stick-like writing nib as claimed in claim 1, which has depressions each formed between an outer end portion of each first ink passages and an adjacent second ink passage to said first ink passage.

4. A stick-like writing nib as claimed in claim 1 wherein said first and second ink passages have substantially the same width.

5. A stick-like writing nib as claimed in claim 1 wherein said central wall has substantially, a same thickness of the thickness of the walls of said first ink passages and the walls of said second ink passages.

* * * * *